US007063111B2

(12) United States Patent
Schlösser

(10) Patent No.: US 7,063,111 B2
(45) Date of Patent: Jun. 20, 2006

(54) METHOD OF AND DEVICE FOR FILLING A BAG HAVING AIR EXTRACTING MEANS

(75) Inventor: Werner Schlösser, Hennef (DE)

(73) Assignee: BMH Chronos Richardson GmbH, Hennef (DE)

( * ) Notice: Subject to any disclaimer, the term of this patent is extended or adjusted under 35 U.S.C. 154(b) by 451 days.

(21) Appl. No.: 10/436,912

(22) Filed: May 13, 2003

(65) Prior Publication Data

US 2003/0230353 A1 Dec. 18, 2003

(30) Foreign Application Priority Data

May 15, 2002 (DE) ..... 102 21 567

(51) Int. Cl.
*B65B 1/04* (2006.01)

(52) U.S. Cl. ..... 141/10; 141/313; 141/256

(58) Field of Classification Search ..... 141/255, 141/256, 301, 67, 114, 313, 10; 222/226, 222/236, 239–243, 246
See application file for complete search history.

(56) References Cited

U.S. PATENT DOCUMENTS

| | | | | |
|---|---|---|---|---|
| 2,142,990 | A * | 1/1939 | Belcher | 141/44 |
| 2,330,862 | A * | 10/1943 | Bleam | 141/49 |
| 3,580,419 | A * | 5/1971 | Carter | 222/1 |
| 4,703,782 | A * | 11/1987 | Henkel, Sr. | 141/65 |

FOREIGN PATENT DOCUMENTS

| | | |
|---|---|---|
| DE | 1 194 312 B | 12/2002 |
| DE | 25 55 347 A1 | 12/2002 |
| DE | 75 07 947 U1 | 12/2002 |
| DE | 199 62 475 C2 | 12/2002 |
| DE | AT 301 499 | 12/2002 |

* cited by examiner

*Primary Examiner*—Steven O. Douglas

(57) ABSTRACT

A method of filling a bag with pourable, especially powdery material, by means of a dispensing device with a vertical filling pipe which can be introduced into the bag and which comprises flanging-on means at its upper end and a closing device at its lower end, wherein prior to or during the filling operation, air is extracted from the material above the closing device via the inside of the filling pipe.

12 Claims, 1 Drawing Sheet

METHOD OF AND DEVICE FOR FILLING A BAG HAVING AIR EXTRACTING MEANS

FIELD OF INVENTION

The invention relates to a method of filling a bag with pourable, especially powdery material, by means of a dispensing device with a vertical filling pipe which can be introduced into the bag and which comprises flanging-on means at its upper end and a closing device at its lower end. The upper end of the filling pipe is connected to a feeding funnel. The closing device comprises a closing cone which is adjustable in the vertical direction and which, in an open position, provides an annular gap at the lower end of the filling pipe and, in a closed position, rests against an annular face or annular edge at the lower end of the filling pipe by means of its conical face. A method and device of this type is disclosed in German publication DE 199 62 475 C2.

BACKGROUND OF THE INVENTION

When filling bags with a pourable material, it is desirable, on the one hand, to fill the bags quickly and, on the other hand it is necessary to dispense accurate amounts, because it is impermissible to fill the bags with less than the nominal amount and it is uneconomical to allow too great a scatter of the amount contained in a bag above the nominal value. The two requirements in respect of a rapid filling procedure on the one hand and accurate dispensing on the other hand contradict one another because the former requires a large flow of material and the latter a small flow of material. This is the reason why the bags to be filled are filled quickly up to an amount of 90 to 95% of the nominal amount, involving a large flow of material, with the scatter of the result achieved being allowed to be relatively large, and subsequently, a small flow of material ensures accurate filling, with only a few percentage points being above the nominal amount.

One problem of prior art filling techniques occurs when powdery materials are enriched with air during the filling operation. This happens automatically during the travel of the material from the bunker via a weighing machine into the feeding funnel, especially if the feeding funnel contains a stirring mechanism whose purpose it is to maintain the flowing ability of the material. This is disadvantageous in that it is necessary to extract the air from the measured material contained in the bag before the bag is closed. Air extraction probes for this purpose are disclosed in German publication DE 34 14 218 C2 for example. During the deaerating process, the volume of the material filled into the bag is reduced, so that there is an excessively long bag flap which first has to be shortened before the bag is closed.

OBJECT OF THE INVENTION

It is therefore the object of the present invention to provide a method of filling a bag which eliminates the process of deaerating the measured material contained in the bag. The objective is achieved by means of a method wherein, either prior to or during the operation of filling the bag, air is extracted from the material above the closing device via the inside of the filling pipe. In this way, the material is deaerated directly before it flows out of the filling pipe and it cannot subsequently enrich itself again with air. It has to be taken into account that the filling pipe has already been inserted into the bag aperture or it ends directly above the bag aperture. Deaerating can take place before the closing device is opened and/or while the material flows out of the filling pipe. In particular, this applies to the process of coarse dispensing material and, optionally, to a subsequent medium-coarse dispensing material.

SUMMARY OF THE INVENTION

According to a preferred embodiment, it is possible, during the subsequent operation of fine dispensing material, for air to be introduced into the material via the inside of the filling pipe in order to improve the flowing ability of the material. As, in this case, only very small amounts of material are fed in, the percentage of air is correspondingly negligible. This means that there is no longer any need to subsequently extract such a small percentage of air.

In an extremely advantageous way, the method in accordance with the invention allows smaller bags to be used for a certain amount of material to be introduced, such bags being adjusted to and cut to suit the compact, low-air volume of the material. This results in a corresponding cost advantage when purchasing the bags. There is no need to shorten initially over-dimensioned bags after the extraction of air, so that further savings can be made in respect of the cutting device and the costs of the cutting operation. The stability of the bags filled with a low-air material is improved from the start, so that they can be fed in on the conveyor belt of a closing or sealing device in a free-standing condition. Because of the more compact, low-air material the stacking ability of the filled bags is improved at the same time.

The inventive device is characterized in that the filling pipe comprises an outer pipe and a sieving hose which are positioned coaxially inside one another, wherein the annular space between the outer pipe and the sieving hose is connectable to air extracting means. The sieving hose should be arranged close to the exit of the closing device in order to be effective, and it can extend along the whole length of the filling pipe or only along part of the length of same. In the latter case, the sieving hose can be axially complemented by a closed inner pipe. The air extraction process and the air supplying process preferably take place in the annular space between the outer pipe and the inner pipe.

According to an advantageous embodiment the sieving hose is positioned directly above the closing device and that the top end of the sieving hose is followed by an inner pipe with approximately the same diameter. Furthermore the sieving hose may consist of a plurality of wire mesh layers, with the mesh size of the layers of wire mesh increasing from the inside to the outside. The mesh size of the inner layer may amount to a minimum value of 1 μm and in particular ranges between 1 and 5 μm. Furthermore the sieving hose may be held by spacing rings in the outer pipe, which spacing rings comprise axial apertures. Between the sieving hose and the outer pipe, there can be positioned axial supporting members for the sieving hose. In addition the closing device may comprise a closing cone with an upwardly pointing conical face, which closing cone vertically adjustably rests against an end ring which is attached at the lower end of the filling pipe. A conveyor worm is arranged inside the filling pipe, with the closing cone, on its surface, carrying blades. In this way it is possible to finely dispense material by rotatingly driving the closing cone.

DETAILED DESCRIPTION OF THE INVENTION

Figure 1:
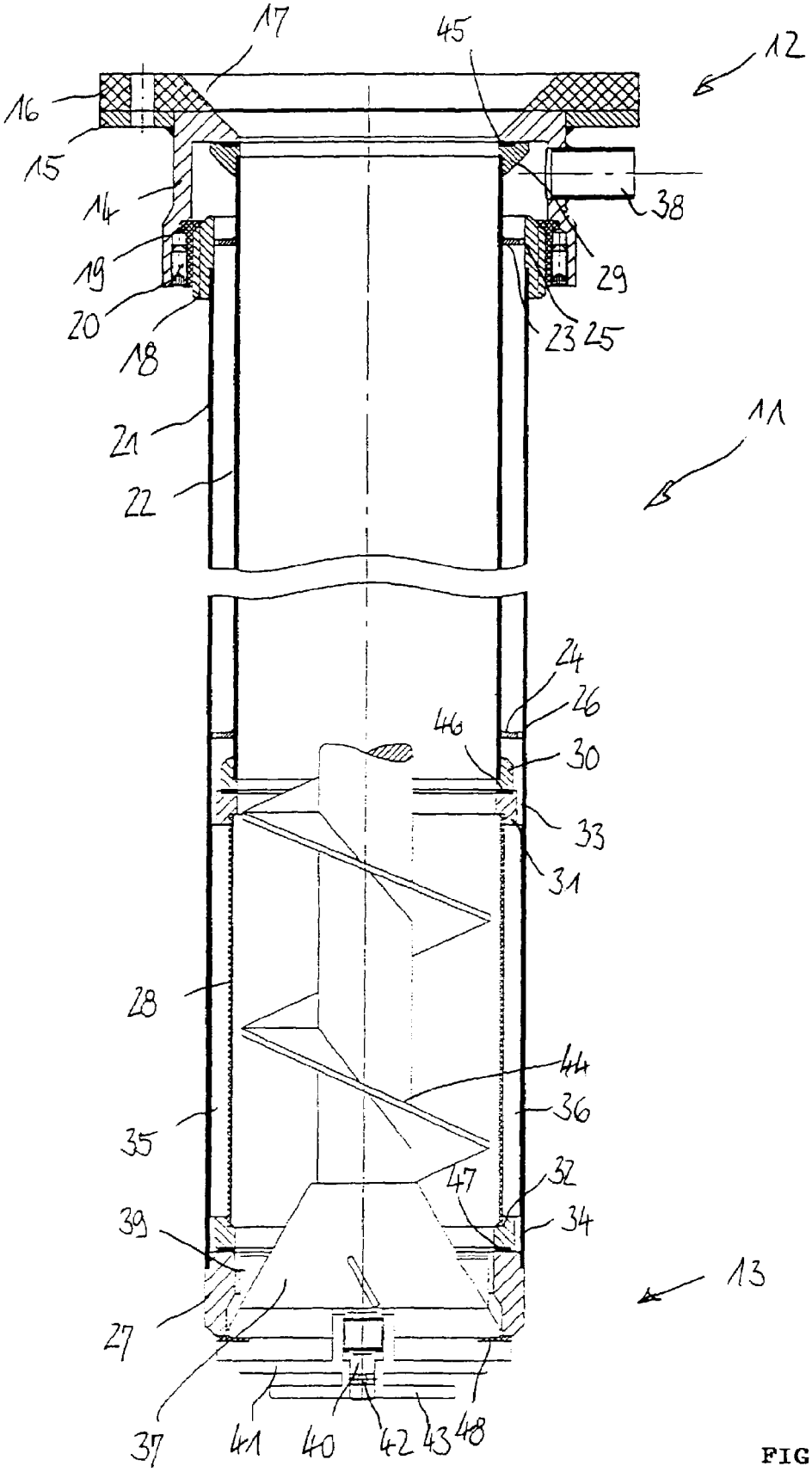
FIG. 1 is a cross sectional elevation view of the device of this invention for filling a bag having air extracting means.

A preferred embodiment of the invention is illustrated in FIG. 1. A filling pipe 11 with a vertical axial A comprises flanging-on means 12 at its upper end and a closing device 13 at its lower end. The flanging-on means consist of a sleeve 14, a flange 15 and a sealing plate 16. The sleeve 14 and the sealing plate 16 form a cone face 17. The flange plate 15 and the sealing plate 16 can be bolted jointedly to a feeding funnel. Into the sleeve 14 there is inserted a threaded bush 19 which, by means of securing pins 20, is fixed in the sleeve 14 in a rotationally fast way. A threaded bush 18 which is screwed into the threaded bush 19 is placed on to an outer pipe 21 of the filling pipe 11. Into the outer pipe 21 there is inserted an inner pipe 22 which is shorter than the outer pipe 21. The inner pipe 22 is centered in the outer pipe 21 by centering rings 23, 24. The centering rings each comprise axial apertures 25, 26 which are uniformly circumferentially distributed. At its upper end, the inner pipe 22 carries an attaching ring 29 and at its lower end it carries an attaching ring 30.

In the outer pipe 21, between the inner pipe 22 and the closing device 13, there extends an inventive sieving hose 28 which has approximately the same diameter as the inner pipe 22. The sieving hose 28 is held between an upper attaching rings 31 and a lower attaching ring 32 which, together with the outer pipe 21, form annular gaps 33, 34. In the outer pipe 21, the sieving hose 28 is centered and its load relieved by circumferentially distributed pressure bars 35, 36 which are inserted between the attaching rings 31, 32.

While threading in the threaded bush 18, the inner pipe 22 and the sieving hose 28 are axially tensioned into the threaded bush 19 against the sleeve 14 by means of an end ring 27 which is positioned and centered in the outer pipe 21 and which forms part of the closing device. Between the sleeve 14 and the attaching ring 29, between the attaching rings 30 and 31 and between the attaching ring 32 and the end ring 27 there are inserted seals 45, 46, 47.

In the end ring 27, there is positioned a multi-part closing cone 37 with an upwardly pointing conical face, which closing cone 37 carries a seal 48 which rests directly against the ring 27. At its upper conical face, the cone 37 comprises blades 39. The multi-part cone 37 comprises a lower holding journal 40, a holding disc 41, a securing split pin 42 and a cover disc 43 for the securing split pin 42. The cone 37 is firmly connected to a conveyor worm 44 which is held in the filling pipe 11 so as to be rotatingly drivable and axially adjustable. At its top end, the conveyor worm 44 is shown in a broken-away form. The filling pipe 11 is shown in a broken-away form in the region of the inner pipe 22 and of the outer pipe 21. By lowering the closing cone 37 by means of the conveyor worm 44, there opens up an annular gap at the lower end of the filling pipe 11 through which gap material can flow out. By rotatingly driving the conveyor worm 44, the material is conveyed in a finely dispensed way. An air extraction sleeve 38 is radially inserted into the sleeve 14. Prior to opening the conveyor worm 44 and/or while rotatingly driving the conveyor worm 44, air is extracted via the inner annular space between the sieving hose 28 and the inner pipe 22 on the one hand and the outer pipe 21 on the other hand. In the course of a late phase of finely dispensing material, air can be supplied by applying pressure.

I claim:

1. A method of filling a bag with pourable, especially powdery material, by means of a dispensing device with a vertical filling pipe which can be introduced into the bag and which comprises flanging-on means at its upper end and a vertically controllable closing cone at its lower end and wherein prior to or during the filling operation, air is extracted from said material above said closing cone via the inside of said filling pipe.

2. A method according to claim 1 wherein during the filling operation, with said vertically controllable closing cone in the open position, air is temporarily introduced into the material via the inside of said filling pipe.

3. A dispensing device for pourable, especially powdery material, having a vertical filling pipe with flanging-on means to be fixed to a feeding funnel and a closing device at the lower end of said filling pipe wherein said filling pipe comprises an outer pipe and a sieving hose which are positioned coaxially inside one another, and wherein an annular space between said outer pipe and said sieving hose is connectable to air extracting means, wherein said sieving hose consists of several layers of wire mesh and wherein that the mesh size of said layers of wire mesh increases from the inside to the outside.

4. A dispensing device according to claim 3, wherein said annular space between said outer pipe and said sieving hose is connectable to air supplying means.

5. A dispensing device according to claim 3, wherein said sieving hose is positioned directly above said closing device and that the top end of said sieving hose is followed by an inner pipe with approximately the same diameter.

6. Dispensing device according to claim 3, wherein said mesh size of the inner layer amounts to at least 1 m and in particular, ranges between 1 and 5 m.

7. A dispensing device according to claim 3, wherein said sieving hose is held in the outer pipe by spacing rings which comprise axial apertures.

8. A dispensing device according to claim 3, wherein between said sieving hose and said outer pipe, there are positioned axial supporting members for said sieving hose.

9. A dispensing device according to claim 3, wherein a conveyor worm is arranged inside said filling pipe.

10. A dispensing device according to claim 3, wherein said closing device is provided with a closing cone which comprises an upwardly pointing conical face and which vertically adjustably rests against an end ring which is attached at the lower end of said filling pipe.

11. A dispensing device according to claim 10, wherein said closing cone is firmly connected to said conveyor worm.

12. A dispensing device according to claim 11, wherein on its conical face, said closing cone carries blades.

* * * * *